US005847517A

United States Patent [19]

Ury et al.

[11] Patent Number: 5,847,517

[45] Date of Patent: Dec. 8, 1998

[54] METHOD AND APPARATUS FOR IGNITING ELECTRODELESS LAMP WITH FERROELECTRIC EMISSION

[75] Inventors: Michael Ury, Bethesda, Md.; David Hammer; Czeslaw Golkowski, both of Ithaca, N.Y.

[73] Assignee: Fusion Lighting, Inc., Rockville, Md.

[21] Appl. No.: 677,536

[22] Filed: Jul. 10, 1996

[51] Int. Cl.[6] ..... H05B 41/16

[52] U.S. Cl. ..... 315/248; 315/344; 315/267; 313/231.61; 313/44

[58] Field of Search ..... 315/248, 39, 344, 315/267; 313/508, 346 R, 385, 231.61, 44

[56] References Cited

U.S. PATENT DOCUMENTS

| | | | |
|---|---|---|---|
| 3,996,495 | 12/1976 | Herman | 315/244 |
| 4,359,668 | 11/1982 | Ury | 315/39 |
| 4,360,762 | 11/1982 | Yamamoto et al. | 315/101 |
| 4,501,993 | 2/1985 | Mueller et al. | 315/248 |
| 4,507,587 | 3/1985 | Wood et al. | 315/39 |
| 4,784,475 | 11/1988 | Polaert | 350/355 |
| 4,894,592 | 1/1990 | Ervin et al. | 315/248 |
| 5,126,638 | 6/1992 | Dethlefesen | 315/326 |
| 5,309,071 | 5/1994 | Karam et al. | 313/509 |
| 5,339,090 | 8/1994 | Crossland et al. | 345/90 |
| 5,404,076 | 4/1995 | Dolan et al. | 313/572 |
| 5,448,135 | 9/1995 | Simpson | 315/39 |
| 5,504,391 | 4/1996 | Turner et al. | 315/248 X |
| 5,508,590 | 4/1996 | Sampayan et al. | 315/169.1 |

OTHER PUBLICATIONS

Riege, H. *Electron Emission from Ferroelectrics—A Review, Nuclear Instruments& Methods in Physics* (1994) pp. 80–89.

*Primary Examiner*—Don Wong
*Assistant Examiner*—Haissa Philogene
*Attorney, Agent, or Firm*—Epstein, Edell & Retzer

[57] ABSTRACT

Ignition of an electrodeless lamp, energized by microwave or radio frequency energy, is achieved by disposing a ferroelectric igniter in the lamp envelope along with the fill material. The igniter responds to switching of its spontaneous ferroelectric polarization by emitting electrons that collide with the atoms of the fill material to discharge further electrons and ultimately provide emission of light. In the preferred embodiment, the microwave or radio frequency energy used to excite the fill material is applied to the ferroelectric igniter to cause switching of its spontaneous ferroelectric polarization. Another preferred feature is the securing of the igniter, in the form of a thin patch or wafer, to the inside surface of the lamp envelope in a generally perpendicular orientation to the electric field in the microwave excitation energy.

30 Claims, 3 Drawing Sheets

METHOD AND APPARATUS FOR IGNITING ELECTRODELESS LAMP WITH FERROELECTRIC EMISSION

BACKGROUND OF THE INVENTION

1. Technical Field

The present invention pertains to improvements in methods and apparatus for igniting fill within bulbs of electrodeless lamps, and has particular, although not limited, utility in lamps of the types disclosed in U.S. Pat. Nos. 5,504,391 (Turner et al), 5,404,076 (Dolan et al), 4,894,592 (Ervin et al), 4,859,906 (Ury et al), 4,359,668 (Ury), and 5,448,135 (Simpson), the disclosures in which are expressly incorporated herein in their entireties.

2. Discussion of the Prior Art:

Electrodeless lamps of the type with which the present invention is concerned are comprised of a light transmissive envelope containing a plasma-forming medium. A microwave or radio frequency (rf) energy source has its output energy coupled to the envelope via a suitable coupling arrangement to excite a plasma, resulting in a discharge of light.

In order to initiate breakdown (i.e., ignite the discharge) various prior art techniques have been suggested. For example, in the aforementioned Ury patent, a supplemental ultraviolet igniter bulb, energized by extracting a portion of the primary microwave energy, emits energetic photons incident on the electrodeless lamp envelope. These photons either cause photoemission of photons from the bulb wall, or ionize the fill within the envelope.

Although ignition devices disposed outside the envelope can be effective, they consume space and add to the cost of the overall lamp assembly. Further, even if an external or supplemental light or energy source is used for starting, starting is not always reliable; in fact, when, as is usually the case, the envelope interior is pressurized with a noble gas to any significant pressure level, starting in this manner is impossible. It is desirable, therefore, to incorporate an ignition medium within the envelope, along with the fill material, to facilitate initial breakdown at relatively low applied energy levels. One category of low ionization potential material suitable for ignition purposes is the group of alkaline metals in either elemental or compound form. These metals are suggested as additives in U.S. patent application Ser. No. 08/149,818 for bulbs having sulfur or selenium, in elemental or compound forms, as the primary fill material. Also suggested for the same purpose in that application are the IIIB metals and alkaline or rare earth elements in elemental or compound form. It is also mentioned in that patent application that the addition of mercury to the bulb improves starting reliability. Copending U.S. patent application Ser. No. 08/438,600, filed May 10, 1995, discloses the use of mercury sulfide or mercury selenite as igniting materials, and further suggests the use of piezoelectric crystals in the fill material as an igniting material.

Some prior art systems assist startup by generating an arc discharge in order to free electrons through the use of a conductive component to concentrate the applied rf or microwave electric field. Other systems employ radioactive material to supply free electrons. These approaches suffer from major disadvantages. Specifically, a concentration or introduction of fields requires additional circuitry components to implement the system, thereby increasing labor requirements and cost. Further, the use of radioactive materials requires special licensing.

FIG. 1 illustrates one of many possible configurations of an electrodeless lamp of the type with which ignition techniques of the present invention are concerned. Specifically, a lamp module 10 includes a housing for a magnetron 11 or other rf or microwave source, a filament transformer 13 supplying filament current to the magnetron 11, and a motor 15 for rotating a bulb and for driving a cooling fan in the form of blower wheel 17. An air inlet 19 for fan 17 is defined in one end of the housing.

A screen assembly 20 defines a microwave cavity wherein a bulb 21 is disposed. Bulb 21 includes a generally spherical discharge envelope 23 supported at the end of an elongate cylindrical stem 25. Stem 25 is secured to a drive shaft 27 of motor 15 to permit the bulb 21 to be rotated about the longitudinal axis of its stem 25. Although the bulb in this embodiment is rotated, it is to be understood that the ignition method and apparatus of the present invention apply to both rotated and non-rotated electrodeless bulbs. Bulb 21 has a high pressure fill material contained in its discharge envelope 23 such as, for example, the material described in the above-referenced Dolan et al patent. The bulb envelope is made of quartz or other suitable material. Microwave energy generated by magnetron 11 is fed by a waveguide 27 to a coupling slot 29 providing ingress to the microwave cavity defined by screen unit 20.

The screen unit 20 is made from two members, namely a right cylindrical member having a mesh section 42 and solid section 43, and an end cap 40. Mesh and solid sections 42 and 43 form respective adjacent cylindrical sections of screen unit 20, with solid section 43 extending from the proximal end of the cylinder and mesh section 42 extending from the distal end. End member 40 is a substantially circular mesh member forming a mesh closure at the distal end of the cylinder.

A reflector 50 takes the form of a circular disk typically made from fused silica and has at least one surface 51 with an optically reflective metal oxide coating which does not absorb microwave energy. A small centrally located aperture is defined in disk 50 and is of sufficient size to permit stem 25 of the bulb to pass therethrough. Reflector 50 is positioned coaxially within the microwave cavity at a location corresponding to the annular juncture of mesh section 42 and solid section 43. In this manner reflector 50 effectively defines an optically isolated light transmission chamber by optically closing off the proximal end of mesh section 42 from the remainder of the microwave cavity without affecting the quasi-resonant characteristics of the overall cavity at the operating microwave frequency.

The proximal open end of the screen unit is secured to the lamp assembly by an annular flange 28 extending from the assembly housing. An annular hose clamp (not shown) is placed circumferentially about the proximal end of the screen unit to hold it against flange 28. Coupling slot 29 from the waveguide is located radially inward of flange 28 so that the microwave energy from magnetron 11 can be delivered into the microwave cavity defined by screen unit 20.

The bulb discharge envelope 23 is disposed in the optically isolated optical transmission chamber of the microwave cavity defined circumferentially by cylindrical mesh section 42 and at its ends by reflector 50 and mesh end cap 40. Bulb stem 25 extends through aperture 53 in reflector 50 into the opaque chamber bounded by solid section 43, and then through a suitably provided bore in the lamp assembly housing where the stem is engaged by a rotatable drive shaft of motor 15 to permit rotation of the bulb about the stem axis. As is conventional, one of the effects produced by rotation of the bulb in this manner is the cooling of the bulb discharge envelope 23 in the microwave cavity.

In operation, the waveguide directs the generated energy waves into the microwave cavity, exciting the fill atoms of noble gas (e.g., xenon, argon, krypton, etc.) in bulb 23, which is initially at room temperature, to effect discharge of electrons. The discharged electrons collide with other fill atoms causing a further discharge of electrons, thereby increasing the total population of free electrons. The increased population of free electrons results in increased collisions and increasing temperature, and the excited atoms or molecules of solid or liquid fill material, such as sulfur, mercury, etc., are vaporized and emit the desired optical radiation. As noted above, the fill material in the bulb either does not ignite at all or, occasionally, does not immediately ignite in response only to the applied energy waves, and it becomes desirable to assist the initial ignition. In the prior art, one way of assisting ignition is to include in the bulb additives having low ionization potentials. These additives contain loosely bound electrons capable of being easily dislodged upon excitation by microwave or rf energy so that they can collide with atoms of the fill to discharge electrons from those atoms. The collisions increase and ultimately excite the noble gas fill. Eventually, the fill material emitting the desired light (e.g., sulfur, mercury) is vaporized, resulting in the emission of light.

It is desirable in some applications that the noble gas be provided in the bulb envelope at a relatively high pressure (e.g., up to 760 torr or above) in order to obtain certain operating characteristics. For example, electrodeless lamps with sulfur fill exhibit a significant increase of emitted light intensity as the pressure of the noble gas (e.g., xenon, krypton) increases. However as the gas pressure is increased, ignition of the xenon becomes more difficult and unreliable at normal levels of the microwave or rf excitation energy. The present invention provides an alternative ignition approach whereby an igniter disposed in the bulb emits electrons at relatively low levels of applied microwave or rf energy to facilitate ignition of high pressure fill in an electrodeless lamp.

OBJECTS AND SUMMARY OF THE INVENTION

We have now discovered that an improved starting capability can be obtained in electrodeless lamps by placing a ferroelectric material in the bulb envelope along with the fill material. The ferroelectric material typically takes the form of a thin wafer mounted on or otherwise disposed in the envelope. It is well documented that charge separation and electron emission from the surface of ferroelectric materials can be achieved by rapidly switching the spontaneous ferroelectric polarization of the material. Such polarization switching can be induced by the application of pulsed electric fields or mechanical pressure pulses to the material, or by heating and/or laser illumination of the ferroelectric material. Although all of these excitation methods are within the scope of the present invention, the preferred excitation method is the application of the radiated microwave or rf energy used to excite the fill material. The electrons are emitted from the ferroelectric igniter wafer in response to relatively low applied microwave or rf energy levels as compared to the levels required to reliably ignite the fill material alone.

Accordingly, it is an object of the present invention to provide an inexpensive, reliable and non-intrusive method and arrangement for enhancing ignition in electrodeless lamps without the use of additional circuitry or radioactive materials.

It is another object of the invention to provide an igniter element in with the primary fill material in electrodeless lamps to greatly enhance the starting or ignition capability of the lamp.

A still further object of the invention is to utilize ferroelectric emission to ignite an electrodeless lamp.

According to the present invention, initial ignition of the fill in electrodeless lamps is accomplished by generation of a powerful burst of electrons or an arc from ferroelectric material disposed within the lamp envelope. The electrons in the burst or arc collide with atoms of the inert gas in the envelope to discharge electrons from those atoms at room temperature. These electrons collide with other electrons in the gas, increasing the temperature of the sulfur, mercury or other fill material to vaporize that material so that it may be ignited in the manner described herein. The preferred embodiment utilizes microwave or rf energy to switch the polarization of the ferroelectric material and thereby generate the electron burst that ignites the fill gas. The fill gas may be a high pressure fill (e.g., from above 200 torr to above 760 torr) and is still readily ignited by the ferroelectric emission at normal operating levels of the microwave or rf energy. Advantageously, it is believed that shortly after the lamp has been tuned off, ferroelectric emission of electrons can ignite the hot sulfur or mercury fill directly and thereby reduce the down time required before the lamp may be reignited. In the preferred embodiment of the invention, the ferroelectric igniter takes the form of a wafer or patch disposed within the envelope in a position to be impinged upon by the microwave or radio frequency energy utilized to excite the fill material.

The above and still further objects, features and advantages of the present invention will become apparent upon consideration of the following detailed description of specific embodiments thereof particularly when taken in conjunction with the accompanying drawings wherein like reference numerals and the various figures are utilized to designate like components.

DESCRIPTION OF THE PREFERRED EMBODIMENTS

Figure 1:
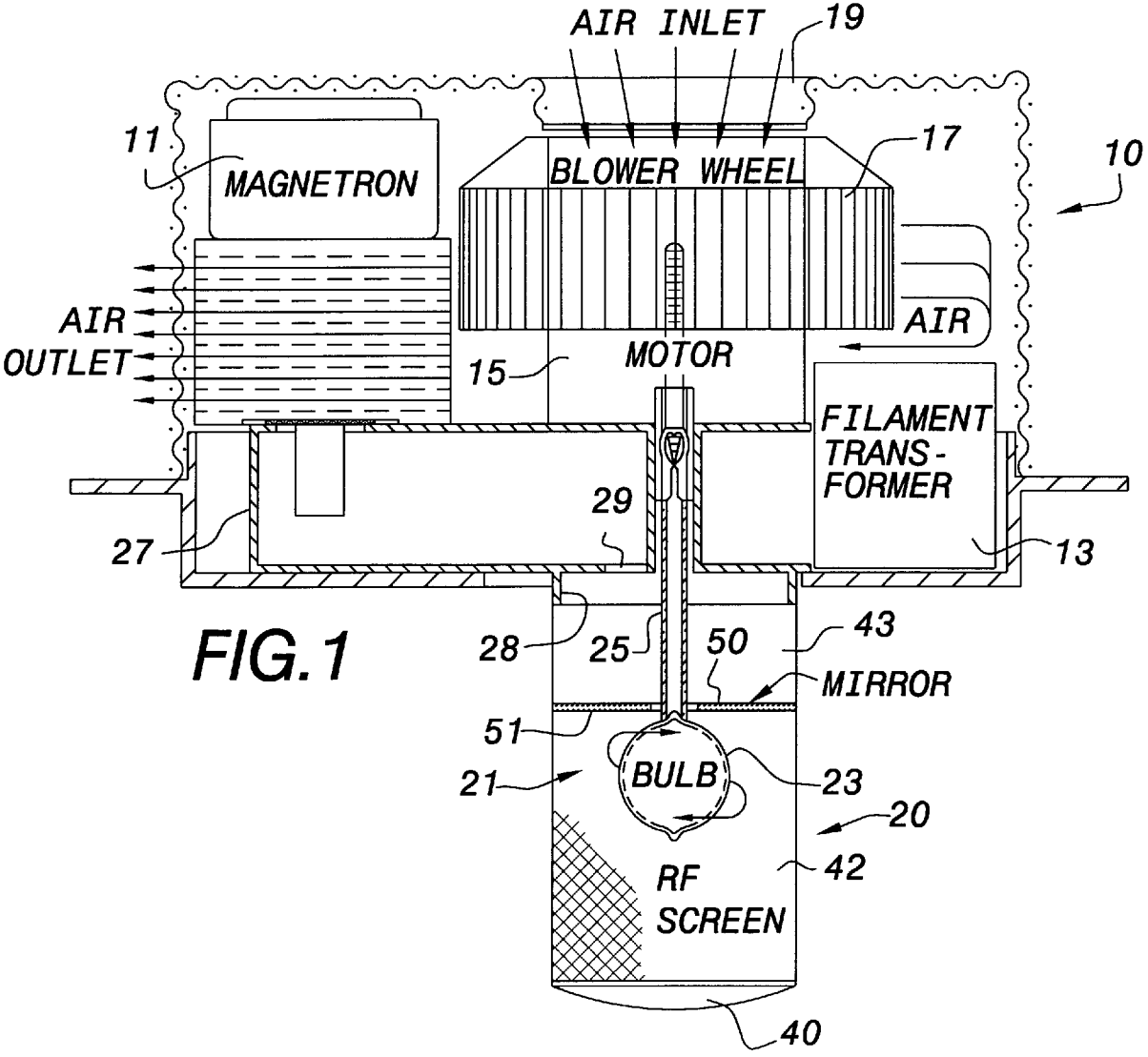
FIG. 1 is a view in elevation and partial section of one example of an electrodeless lamp of the type with which the present invention is utilized.
Figure 2:
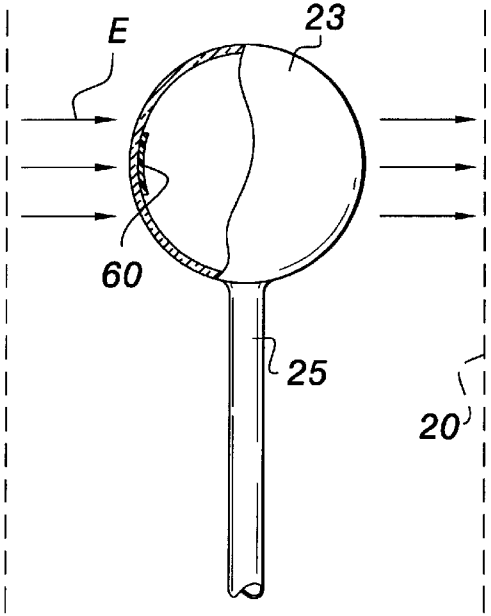
FIG. 2 is a detailed view in elevation and partial section of the lamp of FIG. 1 showing a preferred embodiment of a ferroelectric igniter mounted on the interior surface of the bulb.

Referring specifically to FIG. 2 of the accompanying drawings, the bulb 23 of the lamp assembly of FIG. 1 is provided with a thin igniter wafer or patch 60 of ferroelectric material secured to the interior surface of the bulb. Wafer 60 is secured along one surface thereof to the bulb wall by means of any suitable bonding agent capable of reliably attaching the wafer to the interior surface of the fused silica bulb. Alternatively, the wafer or patch may be secured to the inside wall of the bulb by thin film deposition techniques. The location of wafer 60 is such that the electric field (E) of the microwave or rf excitation energy waves pass generally perpendicularly through the wafer in a direction from the secured surface to its exposed or emission surface facing the bulb interior and the fill material disposed therein.

The preferred configuration of the ferroelectric igniter is a thin wafer or patch. The dimensions of the wafer will, of course, vary with the size constraints of the bulb. Wafer thicknesses in the range between one and fifty microns are preferred, but thicknesses outside that range are feasible. Corresponding bulb wall thicknesses are in the range of 0.5 to 1.0 millimeters for a bulb having an outside diameter on the order of thirty-eight millimeters. We have found that decreasing wafer thickness serves to decrease the voltage level required across the wafer to effect electron emission. The wafer diameter or surface area will, of course, affect the cross-sectional area of the emitted electron beam. For the embodiment described, a circular wafer 60 has a diameter in the range from a fraction of a millimeter to twelve or more millimeters. It is desirable that the diameter (or area, if the wafer is not circular) be as small as possible so as not to significantly block light emission from the bulb. However, the wafer must be large enough to emit an electron beam of sufficient size and energy to ignite the fill material. Accordingly, the wafer size depends to some extent on the lamp size and the particular fill material. It is also possible to use plural spaced smaller ferroelectric wafers rather than a single wafer.

Figure 3:
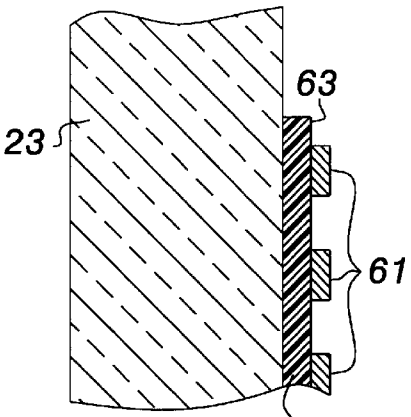
FIG. 3 is a detailed view in section of the ferroelectric and a portion of the bulb of FIG. 1.

Referring to FIG. 3, wafer or patch 60 is preferably provided with a metallic grid 61 on its emission surface 63 (i.e., the surface facing the bulb fill material). The grid 61 is shown in cross-section in FIG. 3 and, therefore, appears as individual elements; however, it is to be understood that the grid is preferably a continuous pattern of conductive metal deposited on, or otherwise applied to, emission surface 63. Preferably, the grid is produced with a combined photoresist-chemical etch process. The thickness of the metallic layer is not critical to electron emission; rather, it is the need for regions of ungrounded conductive metal that permit potentials developed on the emission surface 63 to initiate electron emission. The preferred metal for grid 61 is platinum, although other known conductive metals are certainly suitable for the purpose.

Figure 4:
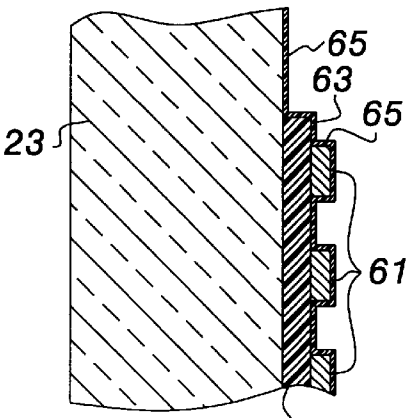
FIG. 4 is a detailed view in section of a portion of the igniter of FIG. 2 showing one form of protective coating applied thereto.

The emission surface 63 is preferably coated, partially or entirely, with a protective layer of dielectric material 65 (FIG. 4) to protect the ferroelectric material and metal conductors from the oxidizing effects of lamp fill material such as sulfur. The protective dielectric material is typically $SiO_2$, or $Al_2O_3$, or both of these applied in successive layers. The thickness of the overall coating is preferably in the range of ten to fifty nanometers.

Figure 5:
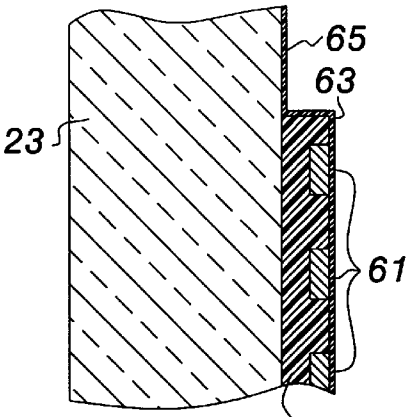
FIG. 5 is a detailed view in section of an alternative embodiment of the igniter of FIG. 3.

As illustrated in FIG. 5, the metal conductors 61 may be embedded in the ferroelectric material 60. The exposed surface of the conductors may be flush with, recessed from or projecting forwardly of the emission surface 63 of the wafer. Protective coating 65 is disposed over the recessed conductors and emission surface 63.

Figure 6:
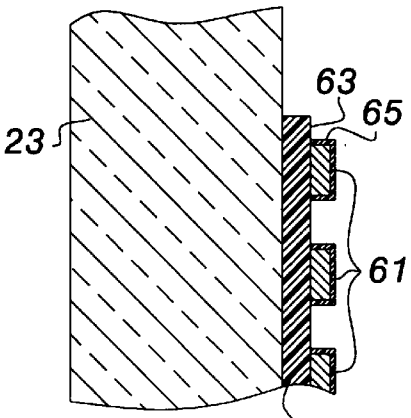
FIG. 6 is a detailed view in section of the igniter of FIG. 2 showing an alternative protective coating applied thereto.

Referring to FIG. 6, protective coating 65 may be deposited only over the metal grid portions 61, leaving the emission surface 63 of the ferroelectric material exposed to facilitate electronic extraction from the wafer.

In the embodiment illustrated in FIG. 2, if the wafer or patch 60 of ferroelectric material is too thin, only a very small voltage will be impressed across the patch by the microwave or rf field directed orthogonal to the patch. That is to say, if the material is too thin, it may not short out the field lines and create enough voltage to charge the wafer. In this regard, the ferroelectric emission phenomenon requires that the material first be charged, and the charge must then be rapidly switched or drained to produce electron emission from its surface. For other applications this may be done by a pulse forming network or some other switching or charging system. Clearly, one cannot run wires or transmission lines to the ferroelectric patch since the microwave excitation field would couple large amounts of energy to those wires or lines. There are a variety of alternative techniques for picking off small amounts of the microwave or rf energy to create a voltage across the ferroelectric wafer. For example, referring to the schematic diagram in FIG. 7, one may use a rectifier-antenna design connected across the thickness dimension of the ferroelectric patch 60. The cap of rectifier 70 is connected to the grid 61 on the electron emission surface; the anode of the diode is connected to the opposite surface of patch 60. The lengths of the dipole elements 71, 72 on the antenna are normally matched to the wavelength of the E field to extract maximum energy from the excitation waves. Since a voltage of only ten to twenty volts is required to switch a thin ferroelectric patch, and since the field strength (E) is on the order of two to ten kilovolts per centimeter, the antenna dipole elements need only be approximately one to two millimeters long in a typical microwave lamp cavity. For example, the cavity shown in the lamp of FIG. 1 is typically excited by 860 watts, and before the lamp ignites it is a moderately high Q cavity. The peak E field is approximately two to ten kilovolts per centimeter within the cavity before ignition.

The ferroelectric wafer charges at a rate limited by the impedance of the antenna structure and the circuit capacitance, the latter being mainly the capacitance of the ferroelectric material. If this capacitance is large, several cycles of the microwave field may be required to develop a full charge across the capacitance. Once the ferroelectric element is charged, it must be rapidly switched to create the electron discharge (i.e., the ferroelectric emission phenomenon).

For lamps of the type described herein, typical excitation energy frequencies are, as described above, 2.45 Ghz and 915 MHz. The periods of these waves are 0.4 nanoseconds and 1.1 nanoseconds, respectively. The E field rises or falls in approximately one-quarter of that time, or in about 0.1 and 0.28 nanoseconds, respectively. If the ferroelectric patch is very thin (e.g., on the order of ten microns), and if its area is kept small (on the order of 0.1 square millimeters or less), and if the dielectric constant of the material falls off at microwave frequencies, then an antenna which produces a voltage of a few hundred volts is capable of charging the ferroelectric capacitance to the ten to twenty volts level in the required 0.1 nanosecond time frame, and likewise discharge it in the a similar time frame. The desired effect charges and discharges the ferroelectric igniter twice during each cycle of the microwave energy, each time emitting an electron discharge into the inert gas that fills the bulb.

Figure 9:
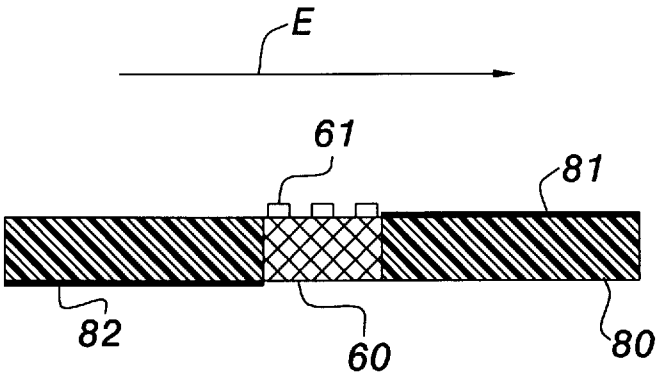
FIG. 9 is a view in vertical section of the mounting arrangement of FIG. 8.
Figure 8:
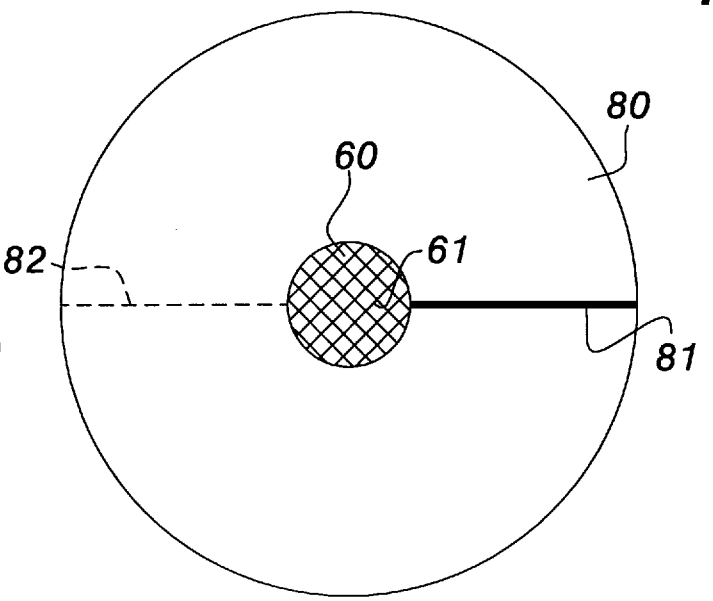
FIG. 8 is a top view in plan of an alternative mounting arrangement for the igniter and incorporating an antenna.
Figure 7:
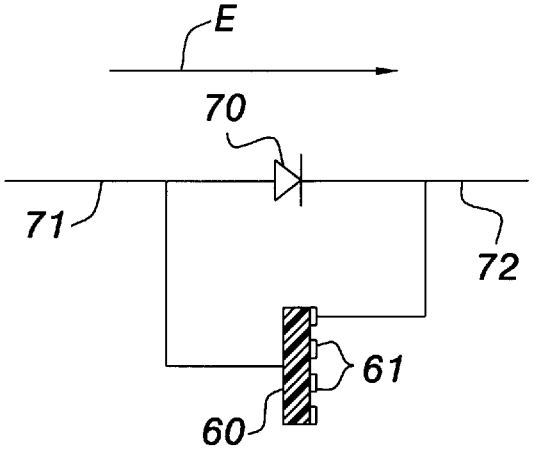
FIG. 7 is a schematic diagram of an antenna arrangement for efficiently charging and draining the ferroelectric igniter of the present invention.

As illustrated in FIG. 7, the antenna dipole element is best placed parallel to the E field in order to create maximum voltage, but it should not project orthogonally relative to the ferroelectric slab or it may enter the plasma and would be difficult to manufacture. The embodiment illustrated in FIGS. 8 and 9 is one possible configuration that may be employed to achieve the desired results. A circular disk 80 of low dielectric material such as fused silica is used as a support for a centrally mounted ferroelectric wafer 60 having a conductive grid 61 mounted on its electron emitting surface. Linear antenna dipoles 81 and 82 extend radially outward from patch 60 along opposite surfaces of support disk 80 and in opposite radial directions (i.e., 180° apart). Disk 80 is mounted such that the E field is parallel to the antenna dipoles and to the electron emitting surface of ferroelectric patch 60. Disk 80 may be secured to the interior wall of the bulb envelope along a small portion of its circumferential edge. Typically, the thickness of disk 80 and patch 60 is on the order of ten microns. The diameter of patch 60 is on the order of 0.9 millimeters, and the diameter of disk 80 is on the order of 3.9 millimeters.

It will be appreciated that persons of ordinary skill in the art may devise a variety of antenna configurations to efficiently charge and discharge the ferroelectric material in accordance with the principles of the present invention.

The embodiment illustrated in FIG. 2 shows the E field passing orthogonally through the ferroelectric material. This embodiment directly induces a rapidly changing voltage across the ferroelectric patch 60 and is the simplest of the various embodiments. However, this embodiment depends on the E field penetrating the ferroelectric material. With the thickness of ten microns, and with a ten kilovolt per centimeter E field, the desired result should be obtainable.

The choice of ferroelectric material for the igniter wafer depends upon particular lamp applications. Examples of such materials include lithium niobate, lithium titanate, barium titanate, tryglycine sulphate (TGS), $Ba_2NaNb_5O_{15}$, $Pb_5Ge_3O_{11}$, $Gd_2(M_oO_4)_3$, lead-lanthanum-zirconium-titanate (PLZT) and lead-zirconium-titanate (PZT). The latter two materials have certain advantages in view of their relatively low Curie temperatures and relatively low cost. PLZT, for example, has a Curie temperature on the order of 360° C.

In operation, referring to FIG. 2, the electric field of the applied microwave or rf excitation energy establishes a voltage across wafer 60. The voltage on the emission surface 63 and grid 61 rises in the same sense as the voltage on the opposite surface. At some voltage level there is a breakdown in the voltage across the wafer which corresponds to a rapid switching of the spontaneous ferroelectric polarization, the voltage swinging rapidly through zero volts. This breakdown coincides with the emission of an electron beam from the emission surface 63. The metal conductors 61 of the grid on emission surface 63 block the electric field of the microwave excitation energy, thereby enhancing the field by forcing it to pass around the edges of the conductors and through the gaps between the conductors. The enhanced field facilitates electron emission when the field reverses direction (i.e., polarity) during alternate half cycles of the excitation energy waveform. The electrons in the emitted beam collide with atoms in the fill material and, in the manner described above, ignite the lamp.

In the preferred embodiment, a gas such as xenon or argon is included in the fill material in bulb 23 at a pressure typically in the range of from fifty torr to seven hundred sixty torr, or higher. Ferroelectric material is believed to be capable of rapidly and reliably igniting the lamp under these pressure conditions in response to microwave energy levels that normally do not produce reliable or rapid ignition of the fill material itself. As described above, the xenon or argon (or other nobel gas) in the bulb must first be broken down and excited by the microwave or rf field. The heated gas transfers energy to the bulb envelope which is thereby heated. The vapor pressure of the light emitting fill material, such as sulfur, mercury or metal halide increases, and the material is vaporized and mixes with the inert gas. The light emitting fill material can then be excited by any of a variety of energy transfer mechanisms to emit the desired light.

A benefit of starting with high pressure xenon (i.e., greater than 50 Torr) is that the relatively high mass of the xenon molecules, combined with the increased number of molecules, acts to create a thermal insulating blanket which reduces heat loss to the walls of the bulb. For example, increasing the pressure of xenon in the bulb from fifty torr to three hundred torr results in an increase in the emitted light intensity of approximately five percent. However, the higher pressure makes ignition of the xenon difficult or unreliable at normal operating levels of the applied microwave or rf energy. The ferroelectric igniter of the present invention, on the other hand, provides reliable ignition at these operating energy levels, even at the higher bulb pressures of up to seven hundred sixty torr or above.

In addition, the improved ignition capability provided by ferroelectric emission reduces down time after the lamp has been extinguished. In particular, when a sulfur fill bulb is turned off, it is necessary to wait for the sulfur to cool off and condense before it can break down again and be ignited. The ferroelectric igniter, however, facilitates ignition of the sulfur, and xenon, to significantly reduce the down time required before the hot lamp may be restruck.

The grid conductors 61 can be configured and sized in any suitable manner. For example, the grid may be formed as a zig-zag pattern of lines or stripes across the emission surface 63. Individual stripes may be, for example, two hundred micrometers wide, spaced by two hundred micrometers, and have a depth less than one micrometer.

Typical frequencies of the excitation energy are 915 MHz and 2.45 Ghz, but these are only preferred operating frequencies and are not to be construed as limiting factors on the scope of the invention.

Tests of ferroelectric emitters in an air gap have shown that breakdown occurs at applied voltage levels on the order of one-sixth or less of the voltage required to otherwise produce gap breakdown. As the wafer or patch 60 is made thinner, the pulse width or half-period of the excitation waveform required to cause electron emission decreases accordingly without reduction of emitted beam energy. In addition, the required switching voltage amplitude decreases roughly in proportion to decreases in wafer thickness. The results of both of these effects is that the amount of energy required to switch the spontaneous polarization of the ferroelectric igniter decreases markedly as the thickness of the wafer or patch decreases. For example, at three hundred torr pressure in a nitrogen-filled gap, the expected breakdown voltage across a one centimeter long gap is on the order of 10 kilovolts; however, the ferroelectric igniter induced a breakdown with an applied voltage of only 1.5 kilovolts.

As noted above, the wafer or patch form is only a preferred form of the ferroelectric igniter of the present invention. The igniter can take any shape and can be provided in multiple spaced component parts (i.e., multiple separate pieces of ferroelectric material).

Utilizing the high frequency excitation energy for the fill material to also switch the spontaneous ferroelectric polarization of the igniter has certain evident advantages over utilizing a separate switching source or mechanism.

However, it is to be understood that the use of mechanical pulsing, heating or laser illumination of the ferroelectric igniter is considered to be within the scope of the invention disclosed and claimed herein.

The ignition techniques described herein are also clearly applicable to excimer lamps of the type disclosed in U.S. Pat. No. 5,504,391 (Turner et al) and containing, for example, xenon chloride at pressures up to several atmospheres when at room temperature.

From the foregoing description it will be appreciated that the invention makes available a novel method and apparatus for igniting electrodeless lamps using ferroelectric emission.

Having described preferred embodiments of a new and improved method and apparatus for igniting electrodeless lamps with ferroelectric emission, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. An electrodeless lamp comprising:

a light transmissive envelope;

a fill disposed in said envelope, said fill having the characteristic of emitting light when ignited and excited by high frequency electrical energy;

means for selectively exciting said fill with said high frequency electrical energy;

ferroelectric material in said envelope for facilitating ignition of said fill, said ferroelectric material having a spontaneous ferroelectric polarization capable of being switched to thereby emit electrons from the material; and means for selectively switching the spontaneous ferroelectric polarization of said ferroelectric material.

2. The lamp of claim 1 wherein said ferroelectric material is in the form of a thin ceramic wafer secured in place inside said envelope.

3. The lamp of claim 2 wherein said wafer has opposed emission and attached surfaces oriented generally perpendicular to an electric field in said high frequency energy.

4. The lamp of claim 2 further comprising an antenna secured to said wafer for receiving said high frequency electrical energy and conducting it to charge said ferroelectric material.

5. The lamp of claim 2 wherein said attached surface is secured to the interior surface of said envelope, and wherein said emission surface faces the fill material within said envelope.

6. The lamp of claim 5 further comprising a pattern of conductive metal disposed on said emission surface.

7. The lamp of claim 6 further comprising a thin protective coating of dielectric material disposed on said emission surface at least covering said conductive material.

8. The lamp of claim 2 wherein said fill includes elemental sulfur or a sulfur compound combined with a gas under pressure in said envelope.

9. The lamp of claim 8 wherein the pressure of said gas in said envelope is in excess of 200 torr.

10. The lamp of claim 1 wherein said ferroelectric material is lead-zirconium-titanate (PZT).

11. The lamp of claim 1 wherein said ferroelectric material is lead-lanthanum-zirconium-titanate (PLZT).

12. The lamp of claim 1 wherein said high frequency electrical energy is microwave energy, and wherein said means for selectively switching includes means for exposing said ferroelectric material to said microwave energy.

13. The lamp of claim 12 wherein said ferroelectric material is secured to the inside surface of said envelope;

wherein said ferroelectric material includes an emission surface facing the fill within said envelope;

and further comprising a pattern of conductive metal disposed on said emission surface.

14. The lamp of claim 1 wherein said high frequency electrical energy is radio frequency energy, and wherein said means for selectively switching includes means for exposing said ferroelectric material to said radio frequency energy.

15. A method for facilitating ignition of a fill in a light transmissive envelope of an electrodeless lamp, said method comprising the step of disposing in said envelope a ferroelectric igniter that emits electrons in response to its spontaneous ferroelectric polarization being switched.

16. The method of claim 15 further comprising the step of selectively switching the spontaneous ferroelectric polarization of said ferroelectric igniter.

17. The method of claim 16 wherein said step of selectively switching includes applying microwave energy to said ferroelectric igniter.

18. The method of claim 17 wherein said fill is excitable by microwave energy to emit electrons and thereby radiate light, and wherein the microwave energy for exciting said fill is derived from the same source as the microwave energy applied to said igniter.

19. The method of claim 16 wherein said step of selectively switching includes applying radio frequency energy to said ferroelectric igniter.

20. The method of claim 19 wherein said fill is excitable by radio frequency energy to emit electrons and thereby radiate light, and wherein the radio frequency energy for exciting said fill is derived from the same source as the radio frequency energy applied to said igniter.

21. The method of claim 15 wherein said step of disposing includes bonding a thin patch of said ferroelectric material to the interior surface of said envelope.

22. The method of claim 15 wherein said step of disposing includes depositing said ferroelectric material on the interior surface of said envelope by means of thin film deposition.

23. The method of claim 15 further comprising the step of disposing an electrically conductive pattern on an electron emitting surface of said igniter.

24. The method of claim 23 further comprising the step of disposing a thin protective layer of dielectric material on said electron emission surface at least covering said pattern.

25. The lamp of claim 15 further comprising the step of pressurizing the interior of said envelope to a pressure level in excess of 200 torr.

26. A method for facilitating ignition of a fill in a light transmissive envelope of an electrodeless lamp, said method comprising the steps of:

(a) disposing in said envelope a ferroelectric igniter that emits electrons when its spontaneous ferroelectric polarization is switched;

(b) switching said spontaneous ferroelectric polarization of said ferroelectric igniter by applying high frequency energy to said ferroelectric igniter to ignite said fill; and (c) exciting said ignited fill with said high frequency energy.

27. The method of claim 26 wherein said high frequency energy is microwave energy.

28. The method of claim 26 wherein said high frequency energy is radio frequency energy.

29. The method of claim 26 wherein said fill includes sulfur or a sulfur compound and a noble gas, and further comprising the step of pressurizing the interior of said envelope with said noble gas to a pressure level in excess of 200 torr.

30. The method of claim 26 wherein step (a) includes bonding said ferroelectric igniter to an interior surface of said envelope.

* * * * *